US006344279B1

(12) United States Patent
Shu

(10) Patent No.: US 6,344,279 B1
(45) Date of Patent: Feb. 5, 2002

(54) BULB ASSEMBLY CONNECTED WITH A DECORATIVE FLOWER

(76) Inventor: Kuo-Fen Shu, No. 10, Lane 198, Chung Cheng Rd., Hsinchu City (TW)

( * ) Notice: Subject to any disclaimer, the term of this patent is extended or adjusted under 35 U.S.C. 154(b) by 0 days.

(21) Appl. No.: 09/822,187

(22) Filed: Apr. 2, 2001

(51) Int. Cl.[7] ..... A47G 35/00

(52) U.S. Cl. ..... 428/542.2; 428/17; 428/24; 362/806; 40/660

(58) Field of Search ..... 428/18, 17, 23, 428/24, 542.2; 362/226, 122, 806, 448, 410; 40/660, 559; 211/205, 96

(56) References Cited

U.S. PATENT DOCUMENTS 3,732,414 A * 5/1973 Franc
5,816,686 A * 10/1998 Wang et al. ..... 362/226
5,947,582 A * 9/1999 Huang ..... 362/122

* cited by examiner

*Primary Examiner*—Deborah Jones
*Assistant Examiner*—Abraham Bahta
(74) *Attorney, Agent, or Firm*—Rosenberg, Klein & Lee

(57) ABSTRACT

A bulb assembly connected with a decorative flower includes a bulb, a bulb holder, a cylindrical sleeve made of an elastic material, and a decorative flower having soft petals. The sleeve is inserted within the lower base of the flower to form a single structure. The sleeve also is sleeved onto tho bulb holder to form the elastic connection with the bulb holder. When a bulb assembly is broken, it can be replaced with a new one, while the use of the decorative flower with soft petals can be continued.

1 Claim, 3 Drawing Sheets

BULB ASSEMBLY CONNECTED WITH A DECORATIVE FLOWER

BACKGROUND OF THE INVENTION

In decorative assemblies, including a bulb and a flower portion having soft petals, typically, the soft petals are glued to the surface of the bulb holder. The process is cumbersome; also the whole decorative assembly is to be discarded when the bulb fails, because the flower portion is integral with the bulb assembly.

Accordingly, the primary object of the invention is to provide a bulb assembly connected with a decorative flower having soft petals through a sleeve removably secured between the flower portion and the bulb holder. The features and advantages of the present invention will be described in detail with reference to the accompanying drawings.

BRIEF DESCRIPTION OF ACCOMPANYING DRAWINGS

DETAILED DESCRIPTION OF THE PREFERRED EMBODIMENTS

Figure 1:
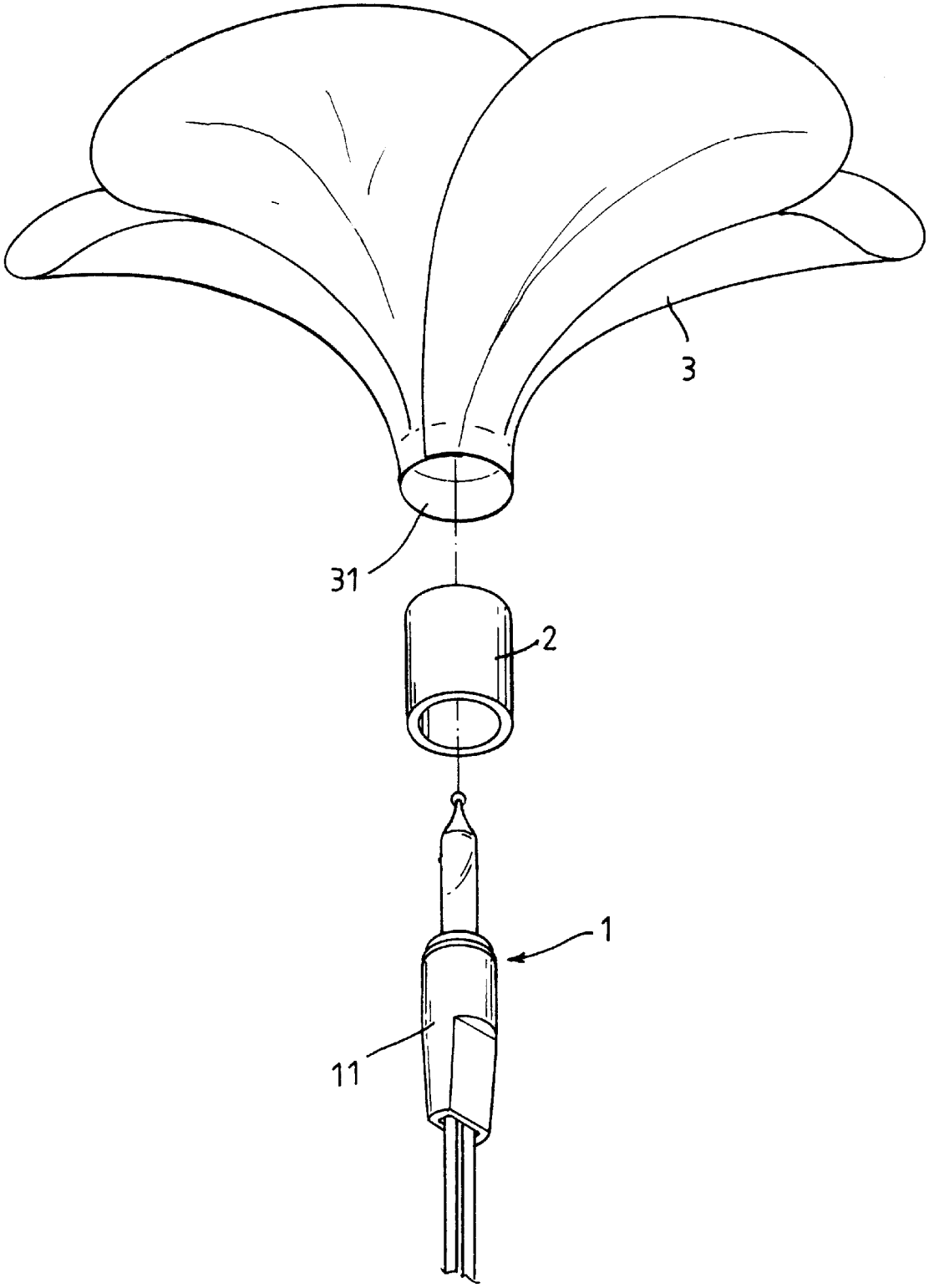
FIG. 1 is an exploded perspective view showing a decorative bulb assembly of the present invention.
Figure 2:
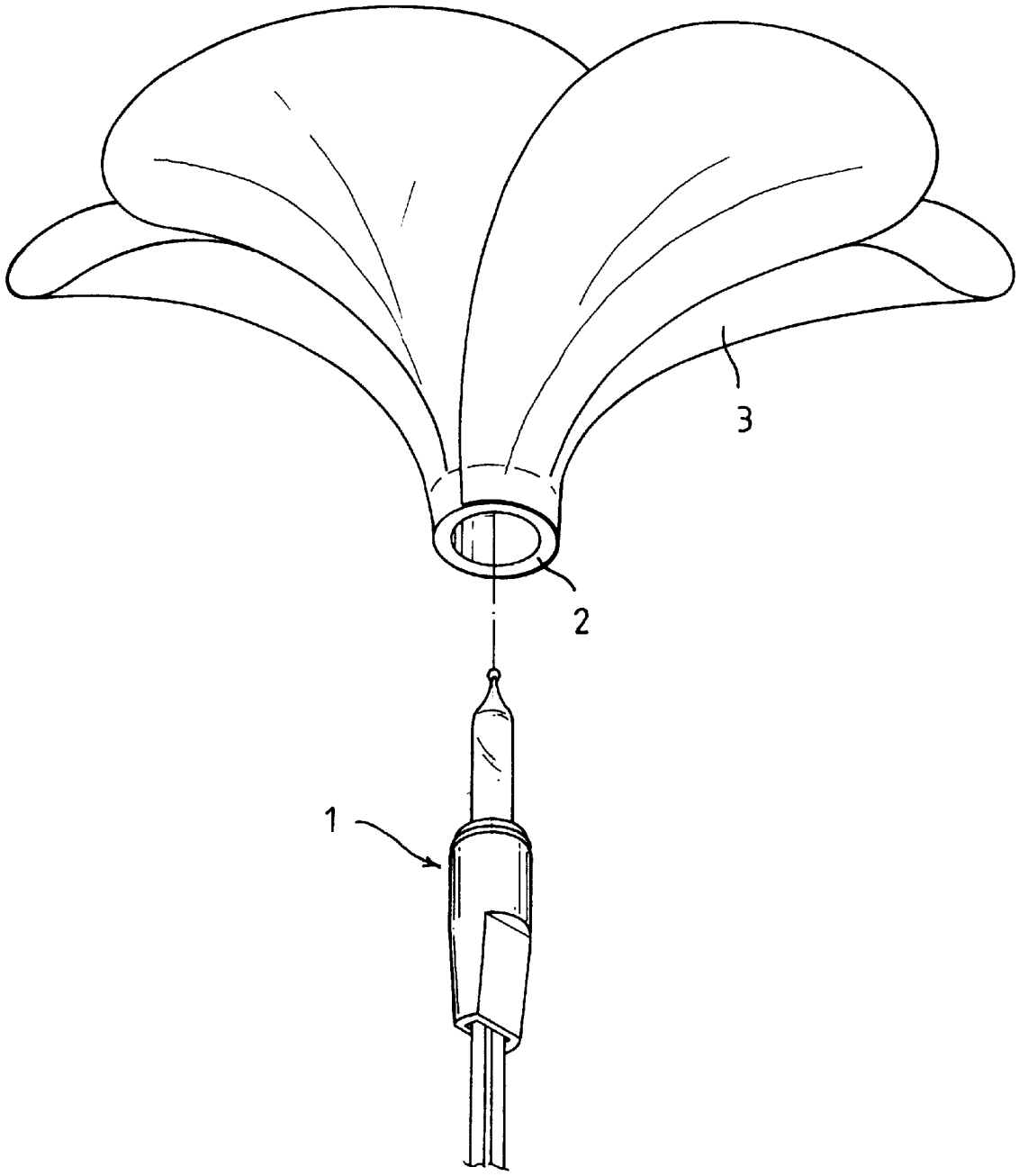
FIG. 2 is a perspective view showing the flower portion assembled with the sleeve of FIG. 1 according to the present invention.
Figure 3:
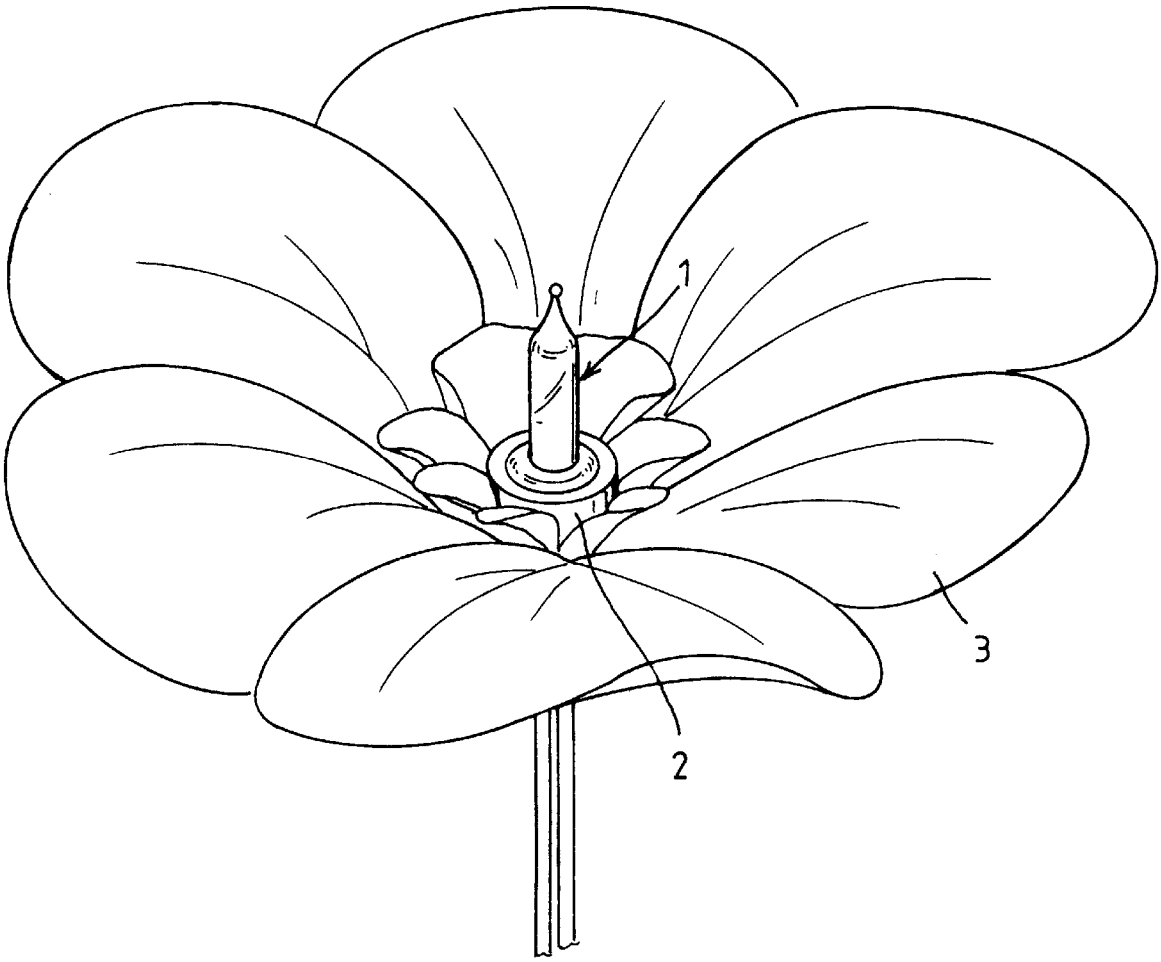
FIG. 3 is a perspective view of the assembled decorative bulb assembly of the present invention.

Referring to FIGS. 1 to 3, the present invention comprises a bulb assembly (1) including a bulb and a bulb holder 11, a sleeve (2), and a flower (3) having soft petals. The lower base (31) of the flower (3) is removably connected with the sleeve (2) to form a single structure. The inner diameter of the sleeve (2) is equal to or slightly smaller than the outer diameter of a bulb holder (11) of the bulb assembly (1). So that when the sleeve (2) is sleeved onto the bulb holder (11) there is a secure connection generated between the bulb assembly (1) and the sleeve (2).

Since the flower (3) and the sleeve (2) are independent elements, they can be manufactured separately and assembled easily and efficiently. The engagement between the sleeve (2) and the bulb assembly (1) is very convenient and stable due to the elastic connection between the sleeve (1) and the bulb holder (11). If the bulb assembly (1) happens to be broken, it can be replaced with a new one, while the soft decorative flower (2) can be used longer.

What is claimed is:

1. A bulb assembly connected with a decorative flower, comprising:

a bulb, a bulb holder supporting said bulb, a flower portion having a lower base and petals extending from said lower base, and a cylindrical sleeve removably secured within an opening in said lower base of said flower portion and sleeved onto said bulb holder to elastically encompass said bulb holder, wherein said cylindrical sleeve is concentrically sandwiched between said lower base of said flower and said bulb holder.

* * * * *